US005237982A

United States Patent [19]

Asakura et al.

[11] Patent Number: 5,237,982

[45] Date of Patent: Aug. 24, 1993

[54] IGNITION APPARATUS FOR INTERNAL-COMBUSTION ENGINE

[75] Inventors: Hideo Asakura, Toyohashi; Satoru Murate, Okazaki, both of Japan

[73] Assignee: Nippondenso Co., Ltd., Kariya, Japan

[21] Appl. No.: 926,324

[22] Filed: Aug. 10, 1992

[30] Foreign Application Priority Data

Aug. 12, 1991 [JP] Japan ..... 3-201774

[51] Int. Cl.[5] ..... F02P 3/02; F02P 15/00

[52] U.S. Cl. ..... 123/635; 123/634

[58] Field of Search ..... 123/634, 635, 647

[56] References Cited

U.S. PATENT DOCUMENTS

| | | | |
|---|---|---|---|
| 4,706,639 | 11/1987 | Boyer et al. | 123/647 |
| 4,834,056 | 5/1989 | Kawai | 123/634 |
| 4,986,233 | 1/1991 | Akagi et al. | 123/635 X |
| 5,125,386 | 6/1992 | De Filippis et al. | 123/635 X |
| 5,152,274 | 10/1992 | Maekawa | 123/635 |

FOREIGN PATENT DOCUMENTS

| | | | |
|---|---|---|---|
| 3922267 | 2/1990 | Fed. Rep. of Germany | 123/635 |
| 0019948 | 2/1985 | Japan | 123/635 |
| 60-190673 | 9/1985 | Japan . | |
| 0195374 | 10/1985 | Japan | 123/635 |
| 63-58910 | 3/1988 | Japan . | |
| 2-207512 | 8/1990 | Japan . | |
| 1498942 | 1/1978 | United Kingdom | 123/635 |

*Primary Examiner*—Willis R. Wolfe

*Attorney, Agent, or Firm*—Cushman, Darby & Cushman

[57] ABSTRACT

An ignition apparatus for an internal-combustion engine, comprises an ignition coil for generating a high-voltage electricity, a socket for supplying the high-voltage electricity to an electrode of a spark plug, and an electrically insulating resin support member which adheres to both of the ignition coil and the socket to support them integrally thereon, and at least a part of the socket is made of an electrically conductive resin.

8 Claims, 6 Drawing Sheets

IGNITION APPARATUS FOR INTERNAL-COMBUSTION ENGINE

BACKGROUND OF THE INVENTION AND RELATED ART STATEMENT

The present invention relates to an ignition apparatus for an internal-combustion engine.

In a prior-art ignition apparatus as disclosed in Japanese Patent Unexamined Publication No. 60-190673, spark plugs are electrically connected to ignition coils through electrodes arranged in a power distribution plate, so that high-voltage cords are not used therebetween and the ignition apparatus can be easily mounted on an internal-combustion engine.

OBJECT AND SUMMARY OF THE INVENTION

An object of the present invention is to provide an ignition apparatus for an internal-combustion engine, which apparatus can securely hold an ignition coil for generating a high-voltage electricity and a socket for supplying the high-voltage electricity to an electrode of a spark plug, and can effectively prevent an electrical noise from being generated therefrom.

According to the present invention, an ignition apparatus for an internal-combustion engine, comprises an ignition coil for generating a high-voltage electricity, a socket for supplying the high-voltage electricity to an electrode of a spark plug, at least a part of the socket being made of an electrically conductive resin, and an electrically insulating resin support means which adheres to both of the ignition coil and the socket to support them integrally thereon.

Since the electrically insulating resin support means adheres to both of the ignition coil and the socket to support them integrally thereon, a rigidity of the ignition apparatus is formed not only by the electrically insulating resin support means, but the rigidity of the ignition apparatus is formed by a combination of the electrically insulating resin support means, the ignition coil and the socket. That is, rigidities of the ignition coil and the socket are used effectively for increasing the rigidity of the ignition apparatus or for reinforcing the rigidity of the electrically insulating resin support means. In addition, the rigidities of the ignition coil and the socket are also used effectively for increasing a strength of the ignition apparatus or for reinforcing a strength of the electrically insulating resin support means. Further, since at least the part of the socket is made of the electrically conductive resin, the electrical noise is prevented from being generated from the high-voltage electricity.

DETAILED DESCRIPTION OF PREFERRED EMBODIMENTS

Figure 1:
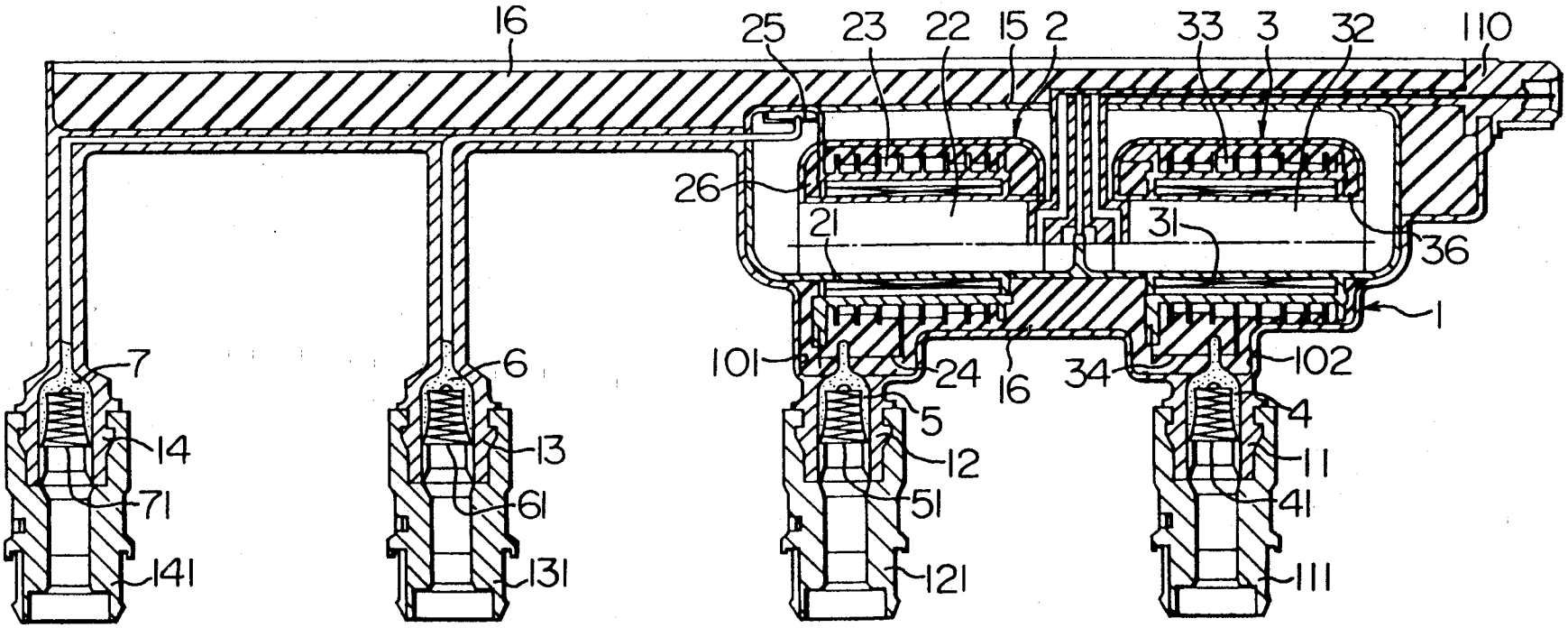
FIG. 1 is a cross-sectional view showing a first embodiment of the present invention.
Figure 2:
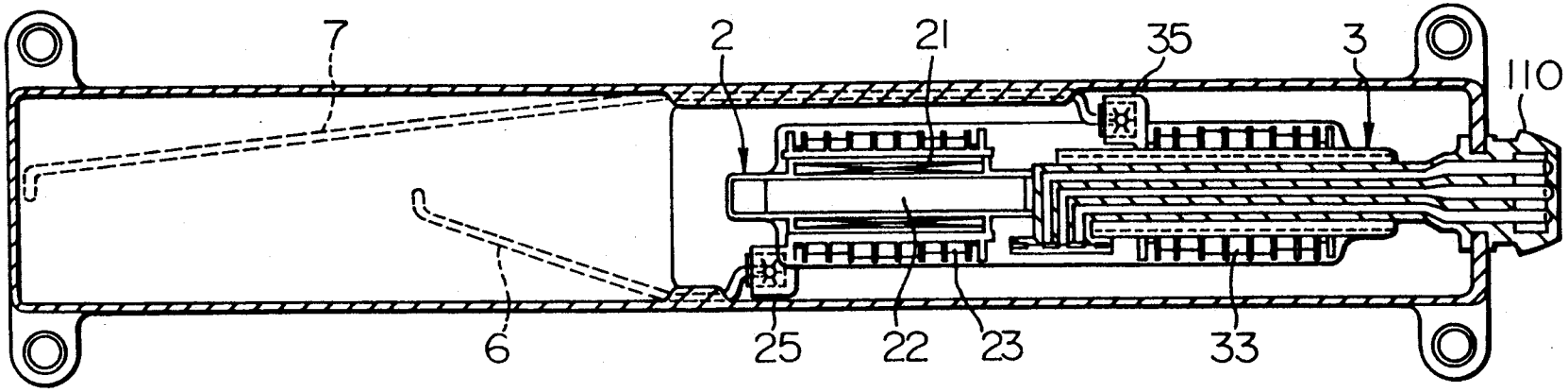
FIG. 2 is a cross-sectional view showing the first embodiment.

In a first embodiment of ignition apparatus according to the present invention, as shown in FIGS. 1–4, a housing 1 has spark plug receiving portions 11, 12, 13 and 14 and surrounds and adheres fixedly to ignition coils 2 and 3 and sockets 4, 5, 6, 7 each of which is made of an electrically conductive resin and has a cup-shaped portion received by the spark plug receiving portion 11, 12, 13 and 14 for receiving an electrode of spark plug (not shown) and a rod portion extending from the spark plug receiving portion 11, 12, 13 and 14. Hollows 101 and 102 are formed in the housing 1 which is made of an electrically insulating resin and has a connector 110.

Each of the ignition coils 2 and 3 has a primary coil 21, 31 energized by a primary pulse electric current, a L-shaped iron core 22, 32 storing and discharging a magnetic energy and a secondary coil 23, 33 generating a high voltage from the magnetic energy. A core mold dead 15 is formed arround the L shaped iron cores 22, 32. The secondary coils 23, 33 are wound on respective secondary coil spools 26, 36 on which terminal plates 24, 25, 34, 35 made of an electrically conductive material are mounted. Ends of the secondary coils 23, 33 are electrically connected to the terminal plates 24, 25, 34, 35, respectively. The cup-shaped portions of the sockets 4, 5, 6, 7 receive the spark plug electrodes respectively to supply the high voltage thereto. The rod portions of the sockets 4, 5, 6, 7 extend from the cup-shaped portions into respective holes of the terminal plates 24, 25, 34, 35 so that the cup-shaped portions are electrically connected to the terminal plates 24, 25, 34, 35. Parts of the rod portions adhere to a bottom portion of the housing 1.

The electrically conductive resin of the sockets 4, 5, 6, 7 has an electric resistance between several-kirohms/meter and tens-of-kirohms/meter, and is made by using a method in which an electrically conductive powder or fiber (carbon, stainless steel, brass or the like) is distribute in a melted resin (rubber, polyethylene, polypropylene, ABS or the like). Inner surfaces of the cup-shaped portions of the sockets 4, 5, 6, 7 are metalized and are connected to the spark plug electrodes through springs 41, 51, 61, 71 compressed between the electrodes and the metalized inner surfaces.

Figure 3:
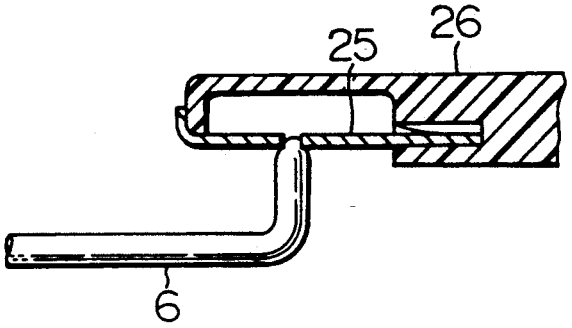
FIGS. 3 and 4 are partially cross-sectional views showing a connection between an electrically conductive rod and a terminal plate.
Figure 4:
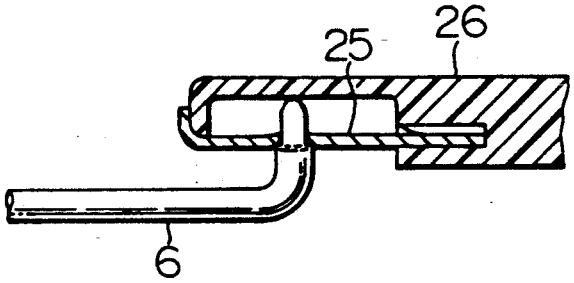

In a method for producing the first embodiment of ignition apparatus, at first, the housing 1 is molded with incorporating the cup-shaped portions of the previously molded sockets 4, 5, 6, 7 therein The ignition coils 2 and 3 with the terminal plates 24, 25, 34, 35 are inserted into the housing 1 and the rod portions of the sockets 4, 5, 6, 7 are inserted into the holes whose shapes are star-shaped, so that projecting portions of the star shaped holes cut into the rod portions of the sockets 4, 5, 6, 7 as shown in FIGS. 3 and 4. Ends of the primary coils 21, 31 are connected to the connector 110. Subsequently, an electrically insulating adhesive 16 is poured into the housing 1 and are cured therein so that the rod portions of the sockets 4, 5, 6, 7, the ignition coils 2 and 3 and the terminal plates 24, 25, 34, 35 are adhered fixedly to the housing 1 through the electrically insulating adhesive 16. Positions of the rod portions of the sockets 4, 5, 6, 7, the ignition coils 2 and 3 and the terminal plates 24, 25, 34, 35 are fixed in the housing 1 by the electrically insulating adhesive 16. The rod portions of the sockets 4, 5, 6, 7, the ignition coils 2 and 3 and the terminal plates 24, 25, 34, 35 may be adhered directly to the housing 1 without the electrically insulating adhesive 16 in the molding process of the housing 1. The cup-shaped portions of the sockets 4, 5, 6, 7 may be adhered to the housing through the electrically insulating adhesive 16. At last, the springs 41, 51, 61, 71 and plug boots 111, 121, 131, 141 are inserted into the cup-shaped portions of the sockets 4, 5, 6, 7.

Figure 5:
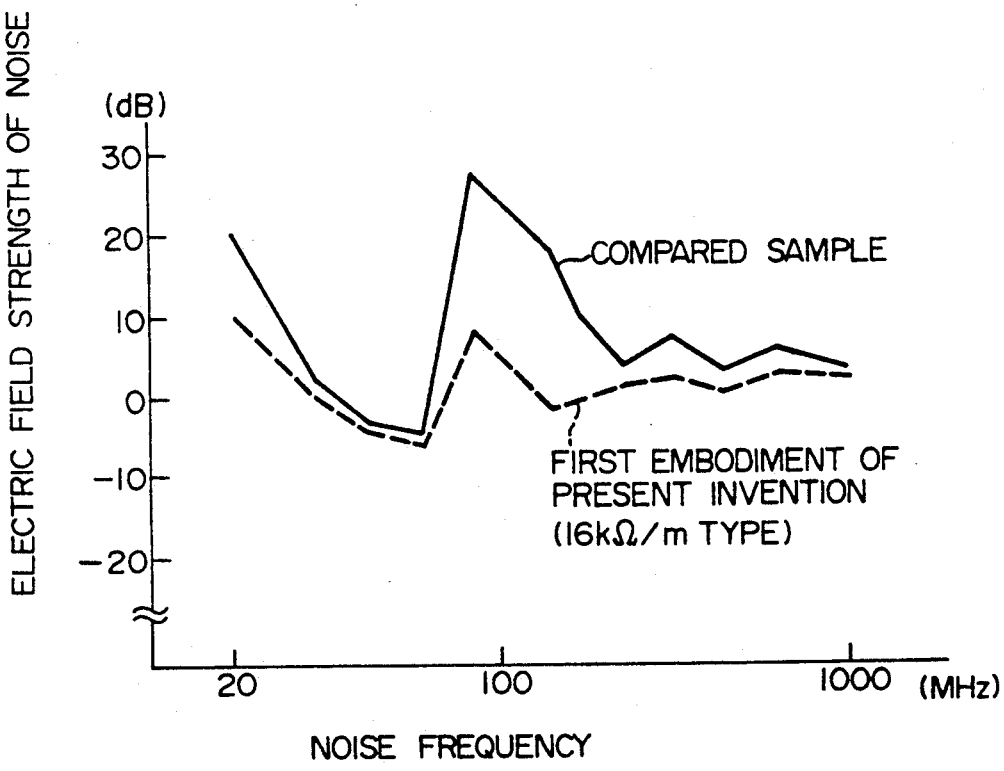
FIG. 5 is a diagram showing a relation between a noise frequency and an electric field strength of noise.

Since the ignition coils 2 and 3 and the cup-shaped portions of the sockets 4, 5, 6, 7 are integrally supported in the housing 1, the ignition apparatus can be easily mounted on the internal-combustion engine. Since the electric resistance of the electrically conductive resin of the sockets 4, 5, 6, 7 is between several-kirohms/meter and tens-of-kirohms/meter, a noise caused by a spark of the spark plug is prevented from radiating from the sockets 4, 5, 6, 7, particularly from the rod portions of the sockets 4, 5, 6, 7 and a malfunction of electric control device is prevented. As shown in FIG. 5, a noise radiation characteristic of the ignition apparatus described above is improved in comparison with that of an prior-art ignition apparatus using a metal sockets instead of the present invention's sockets 4, 5, 6, 7. The noise radiation characteristics were measured by a spectrum-analyzer at an open site with a receiving antenna arranged at 3 meters above the ground and separated by 10 meters from the ignition apparatus, when the ignition apparatus is mounted on a 4-cylinders engine An electrically insulating layer is formed on the sockets 4, 5, 6, 7 during a molding process of thereof, but, the electrically insulating layer is removed therefrom when the rod portions of the sockets 4, 5, 6, 7 are inserted into the star-shaped holes of the terminal plates 24, 25, 34, 35, so that the sockets 4, 5, 6, 7 are connected electrically to the ignition coils 2 and 3.

Figure 6:
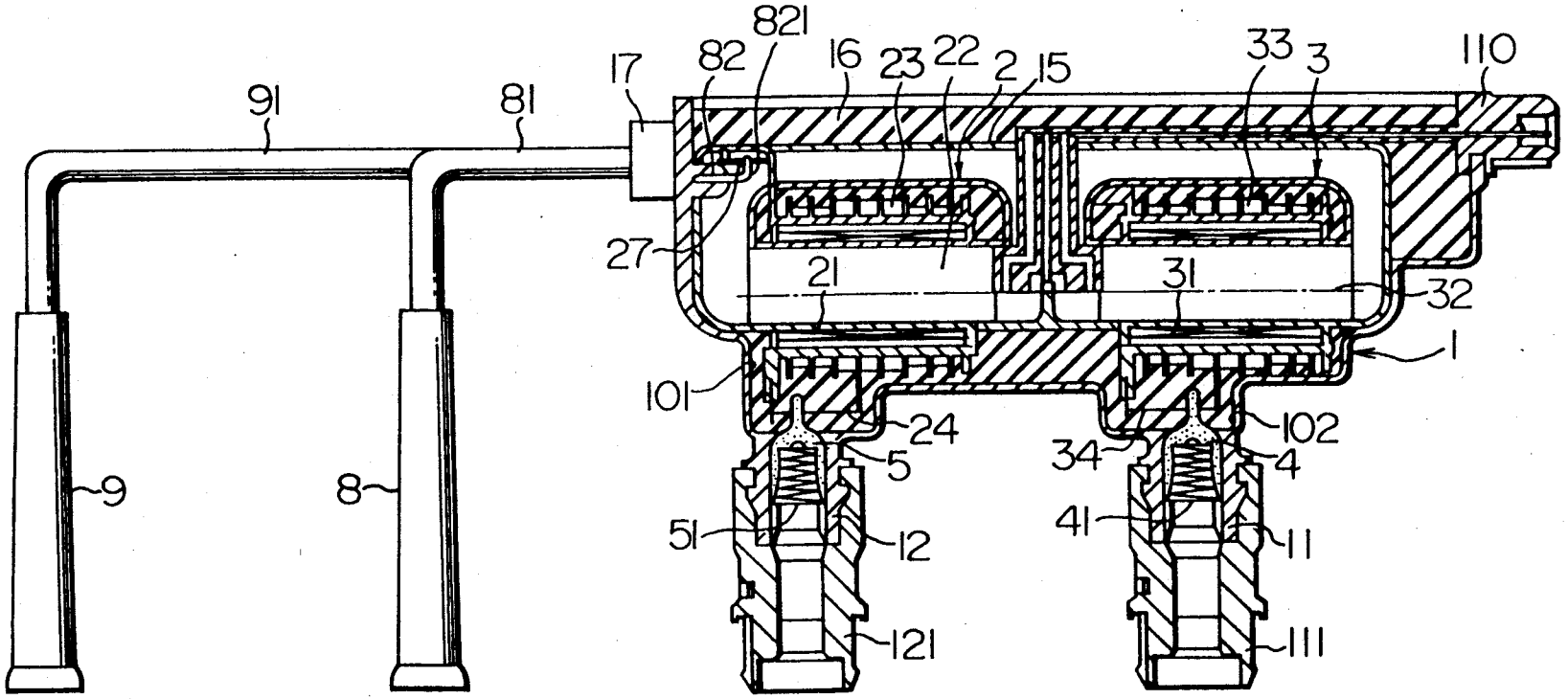
FIG. 6 is a partially cross-sectional view showing a second embodiment of the present invention.
Figure 7:
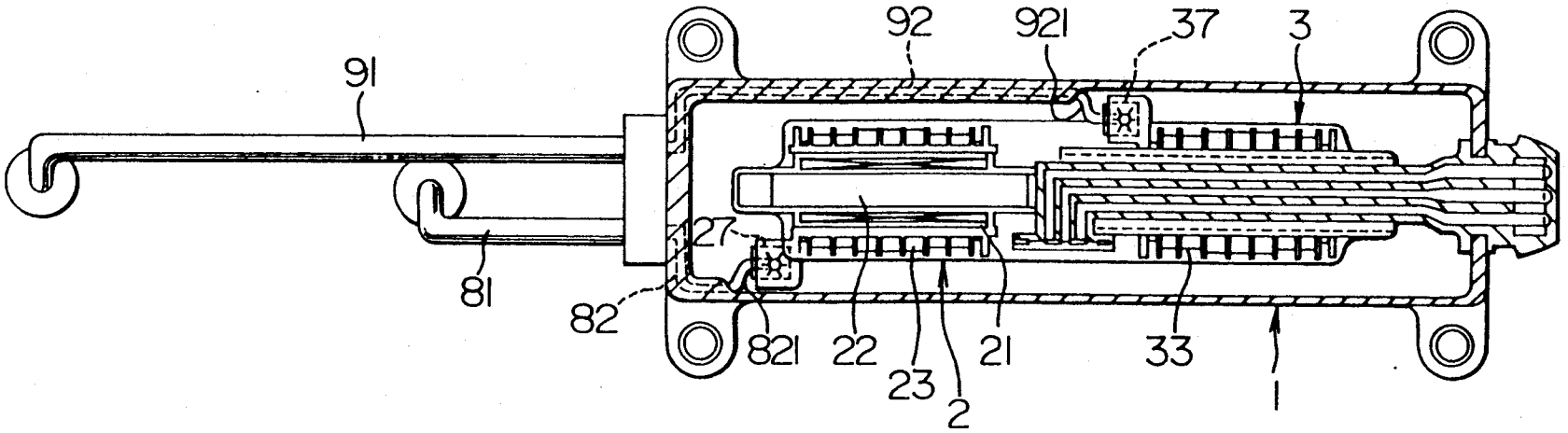
FIG. 7 is a cross-sectional view showing the second embodiment.

In a second embodiment of ignition apparatus according to the present invention, as shown in FIGS. 6 and 7, the housing 1 has the spark plug receiving portions 11 and 12 and surrounds and adheres to the ignition coils 2 and 3 and the sockets 4 and 5 each of which is made of the electrically conductive resin and has the cup-shaped portion received by the spark plug receiving portion 11, 12 and the rod portion extending from the spark plug receiving portion 11, 12. High-tension cords 81 and 91 extend from sockets 8 and 9 which receive the spark plug electrodes respectively to supply the high voltage thereto, so that the sockets 8 and 9 are electrically connected to the ignition coils 2 and 3 through rods 82, 92 which are made of an electrically conductive resin.

The secondary coils 23, 33 are wound on the secondary coil spools 26, 36 on which the terminal plates 24, 27, 34, 37 made of the electrically conductive material are mounted. The ends of the secondary coils 23, 33 are electrically connected to the terminal plates 24, 27, 34, 37, respectively. The rod portions of the sockets 4, 5 and exposed portions 821, 921 of the rods 82, 92 extend into the holes of the terminal plates 24, 27, 34, 37. The rods 82, 92 are electrically connected respectively to the high-tension cords 81 and 91 in a connector portion 17.

In a method for producing the second embodiment of ignition apparatus, at first, the housing 1 is molded with incorporating therein the cup-shaped portions of the previously molded sockets 4, 5 and parts of the previously molded rods 82, 92 other than the exposed portions 821, 921. The ignition coils 2 and 3 with the terminal plates 24, 25, 34, 35 are inserted into the housing 1, and the rod portions of the sockets 4, 5 and the exposed portions 821, 921 of the rods 82, 92 are inserted into the star-shaped holes of the terminal plates 24, 27, 34, 37. The ends of the primary coils 21, 31 are connected to the connector 110. Subsequently, the electrically insulating adhesive 16 is poured into the housing 1 so that the rod portions of the sockets 4, 5, the exposed portions 821, 921, the ignition coils 2, 3 and the terminal plates 24, 27 34, 37 are adhered into the housing 1 through the electrically insulating adhesive 16. The rod portions of the sockets 4, 5, the exposed portions 821, 921, the ignition coils 2, 3 and the terminal plates 24, 27, 34, 37 may be adhered directly to the housing 1 without the electrically insulating adhesive 16 in the molding process of the housing 1. The cup-shaped portions of the sockets 4, 5 may be adhered to the housing through the electrically insulating adhesive 16. The rods 82, 92 are connected respectively to the high-tension cords 81 and 91 in a connector portion 17. The springs 41, 51, 61, 71 and plug boots 111, 121 are inserted into the sockets 4, 5, 6, 7.

Since the ignition coils 2 and 3 and the cup-shaped portions of the sockets 4, 5 are integrally supported in the housing 1, the ignition apparatus can be easily mounted on the internal-combustion engine. Since the sockets 8 and 9 and the high-tension cords 81 and 91 are not integrally formed with the housing 1, a size of the housing 1 may be small and a necessary amount of the electrically insulating adhesive 16 for filling the inside of the housing 1 may be small. Since the electric resistance of the electrically conductive resin of the sockets 4, 5, 8, 9 and the rods 82, 92 is between several-kirohms/meter and tens-of-kirohms/meter, the noise caused by the spark of the spark plug is prevented from radiating from the sockets 4, 5, 8, 9 and the rods 82, 92 and the malfunction of electric control device is prevented.

The internal combustion engine to which the ignition apparatus according to the present invention is applied may have any number of combustion chambers. When a length of the rod portions of the socket 4, 5 is small, the rod portions or the whole of the socket 4, 5 may be made of a metal. Outer surfaces of the rod portions of the socket 4, 5 and the exposed portions 821, 921 of the rods 82, 92 may be metalized to be electrically connected to the ends of the secondary coils 23, 33 through a soldering.

What is claimed is:

1. An ignition apparatus for supplying a high-voltage electrically to a spark plug for each combustion chamber in an internal combustion engine without a distributor, comprising, a plurality of ignition coils, each of which includes a primary coil, a core and a secondary coil including ends between which the high-voltage electricity is generated, sockets whose number is twice as many as a number of the ignition coils, the high-voltage electricity from each of the ignition coils being transmitted to the spark plugs through the sockets, connector members, each of which connects electrically the end of the secondary coil to the socket, and an electrically insulating resin support means which adheres to the ignition coils, the sockets and the connector members to support them integrally thereon, wherein at least a part of a combination of each of the sockets and each of the connector members is made of an electrically conductive resin.

2. An ignition apparatus according to claim 1, wherein the electrically conductive resin has an electrical resistance between several kilohms/meter and tens of kilohms/meter.

3. An ignition apparatus according to claim 1, wherein the electrically insulating resin support means includes an electrically insulating resin housing for receiving the ignition coils, and an electrically insulating resin adhesive portion which is inserted and cured in the housing.

4. An ignition apparatus according to claim 3, wherein the electrically insulating resin adhesive portion adheres to the part of the combination of each of the sockets and each of the connector members to support them in the housing.

5. An ignition apparatus according to claim 3, wherein the part of the combination of each of the sockets and each of the connector members adheres to the electrically insulating resin housing and is embedded therein.

6. An ignition apparatus according to claim 3, wherein the electrically insulating resin housing receives two of the ignition coils, two of the sockets are fixed to a bottom surface of the housing, and the ignition apparatus further comprises high-tension cords each of which extends from a side surface of the housing to the other two of the sockets to connect the ignition coil to the sockets.

7. An ignition apparatus according to claim 3, wherein the electrically insulating resin housing receives two of the ignition coils, four of the sockets are fixed to the housing with a constant distance between adjacent any ones of the sockets, two of the sockets are arranged on a bottom surface of the housing, and the other two of the sockets are arranged apart from a side surface of the housing.

8. An ignition apparatus according to claim 7, wherein each of the connector members connecting the ignition coils to the sockets arranged on the bottom surface of the housing is supported by the electrically insulating resin adhesive portion in the housing, and each of the connector members connecting the ignition coils to the sockets arranged apart from the side surface of the housing is fixedly embedded in the housing.

* * * * *